US007835662B2

(12) United States Patent
Zona

(10) Patent No.: US 7,835,662 B2
(45) Date of Patent: Nov. 16, 2010

(54) WEB FED CHARGING ROLL CLEANER

(75) Inventor: Michael F Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 332 days.

(21) Appl. No.: 12/112,617

(22) Filed: Apr. 30, 2008

(65) Prior Publication Data

US 2009/0274479 A1 Nov. 5, 2009

(51) Int. Cl.
*G03G 15/02* (2006.01)
*G03G 21/00* (2006.01)

(52) U.S. Cl. ..... 399/100; 399/176; 399/352

(58) Field of Classification Search ..... 399/100, 399/168, 174, 176, 352, 98, 123
See application file for complete search history.

(56) References Cited

U.S. PATENT DOCUMENTS 2,912,586 A 11/1959 Gundlach
3,043,684 A 7/1962 Mayer
3,186,838 A * 6/1965 Graff, Jr. et al. ..... 430/119.7
3,398,336 A 8/1968 Martel et al.
3,684,364 A 8/1972 Schmidlin
3,702,482 A 11/1972 Dolcimascolo et al.
3,776,631 A * 12/1973 Mammino ..... 399/348
5,412,455 A 5/1995 Ono et al.
5,463,450 A 10/1995 Inoue et al.
5,499,078 A * 3/1996 Kurokawa et al. ..... 399/31
6,298,205 B1 * 10/2001 Chigono et al. ..... 399/174
6,923,312 B2 * 8/2005 Pham et al. ..... 198/495
7,664,424 B2 * 2/2010 Suganuma et al. ..... 399/100
2009/0274480 A1 * 11/2009 Zona ..... 399/100

OTHER PUBLICATIONS

Copending U.S. Appl. No. 12/112,620, filed Apr. 30, 2008, entitled Web Fed Charging Roll Cleaner by Michael F. Zona.

* cited by examiner

*Primary Examiner*—David M Gray
*Assistant Examiner*—Rodney Bonnette

(57) ABSTRACT

An apparatus for applying an electrical charge to a charge retentive surface, wherein a bias charge roll member is situated proximately to a surface to be charged such as, a photoreceptor having a cleaning system which includes a web material in contact with the bias charge roll to remove containments thereform.

15 Claims, 4 Drawing Sheets

WEB FED CHARGING ROLL CLEANER

CROSS-REFERENCE TO RELATED APPLICATIONS

Reference is made to commonly-assigned copending U.S. patent application Ser. No. 12/112,617, filed herewith, entitled Web Fed Charging Roll Cleaner, the disclosure of which is incorporated herein.

FIELD OF THE INVENTION

The present invention relates generally to a roller apparatus for generating a substantially uniform charge on a surface, and, more particularly, concerns a web fed charging roll cleaner.

BACKGROUND AND SUMMARY

When used to charge an imaging member, a roller used to create a charge on another surface or substrate is commonly referred to as bias charge roll ("BCR"). When used to charge a substrate to enable transfer of a developed image from an imaging member to a substrate member, a roller used to create such bias charging is commonly referred to as a bias transfer roll ("BTR"). Although both may differ in details particular to their applications, both represent illustrative embodiments of the present invention.

Generally, the process of electrostatographic reproduction is initiated by substantially uniformly charging a photoreceptive member, followed by exposing a light image of an original document thereon. Exposing the charged photoreceptive member to a light image discharges a photoconductive surface layer in areas corresponding to non-image areas in the original document, while maintaining the charge on image areas for creating an electrostatic latent image of the original document on the photoreceptive member. This latent image is subsequently developed into a visible image by a process in which a charged developing material is deposited onto the photoconductive surface layer, such that the developing material is attracted to the charged image areas on the photoreceptive member. Thereafter, the developing material is transferred from the photoreceptive member to a copy sheet or some other image support substrate to which the image may be permanently affixed for producing a reproduction of the original document. In a final step in the process, the photoconductive surface layer of the photoreceptive member is cleaned to remove any residual developing material therefrom, in preparation for successive imaging cycles.

The above described electrostatographic reproduction process is well known and is useful for both digital copying and printing as well as for light lens copying from an original. In many of these applications, the process described above operates to form a latent image on an imaging member by discharge of the charge in locations in which light from a lens, laser, or LED discharges a charge. Such printing processes typically develop toner on the discharged area, known as DAD, or "write black" systems.

As an alternative to corona generating devices used in charging systems, roll charging systems such as, BCR's and BTR's have been developed and incorporated into various machine environments with limited success. BCR charging systems are exemplified by U.S. Pat. No. 2,912,586, to R. W. Gundlach; U.S. Pat. No. 3,043,684, to E. F. Mayer; U.S. Pat. No. 3,398,336, to R. W. Martel et al.; U.S. Pat. No. 3,684,364, to F. W. Schmidlin; and U.S. Pat. No. 3,702,482, to Dolcimascolo et al., among others, wherein an electrically biased charging roller is placed in contact with the surface to be charged, e.g. the photoreceptive member. Also relevant is U.S. Pat. No. 5,412,455, to Ono et al. wherein a charging device includes: a member to be charged; a charging member connectable to the member to be charged; a power source for supplying an oscillating voltage to the charging member; and a constant voltage element connected electrically in parallel with the power source for generating the oscillating voltage. Also, U.S. Pat. No. 5,463,450, to Inoue et al. discloses a charging apparatus for electrically charging a member to be charged including a charging member contactable to the member to be charged. The member to be charged includes a core and a voltage source for applying an oscillating voltage between the member to be charged and the charging member, wherein the frequency of the oscillating voltage satisfies a predetermined condition. Each of these is hereby incorporated by reference in their entirety.

Additionally, BCR charging systems may be operated in a DC voltage only mode. While this offers less wear and chemical interaction with the photoreceptor surface, the charge uniformity is much more sensitive to toner and additive contamination on the surface of the bias charging roll. This mode of charging typically requires a robust method of keeping the BCR surface clean to achieve good photoreceptor charge uniformity.

In BTR charging systems, DC voltage is typically used. DC voltage attracts dirt, however, especially toner in spaces void of printing substrates, such spaces comprising inter-document zones, areas exposed when printing on less-than-full-width printing media, and similar areas in which the BTR is directly exposed to the charge carrying member or intermediate transfer member.

The top failure mode seen in xerographic systems that use bias charging roll (BCR) architecture is non-uniform halftones due to contamination on the BCR surface. During operation, toner additives that are not cleaned off of the photoreceptor become attached to the surface of the BCR and form localized bands around the roll. These bands then create non-uniform voltage during the charging step, which lead to halftone streaks in the process direction. Current commerically available charge device cleaners are plagued with contaminate capacity problems. In the cross process direction of device rotation, the same area of the roll cleaner comes into the same area of the roll. Over many revolutions, the cleaner fills up with contamination and stops cleaning the surface of the roll. These uncleaned areas create non-uniform charge of the receptor and show up a streaks in halftone areas of the output.

The following invention provides a method to clean a BCR in order to extend xerographic module life and providing uniform halftones. Toner additive and other contamination is removed from the roll by fabric held in contact with the roll. The fabric is continuously replenished by using a web architecture similar to that used in fusing systems. The amount of fabric can be selected based on how long the charging system needs to be used. Fresh fabric is brought into contact with the roll at periodic intervals in order to provide a new cleaning surface against the roll.

In accordance with one embodiment of the present invention, A xerographic printing machine having an apparatus for applying an electrical charge to a member to be charged, comprising: a bias roll member situated in contact with a surface of the member to be charged; means for applying an electrical bias to said bias roll member; and a cleaning mechanism for cleaning said bias roll member, said cleaning mechanism comprises an elongated web of cleaning cloth material being translated in respect to said bias roll member.

BRIEF DESCRIPTION OF THE DRAWINGS

These and other aspects of the present invention will become apparent from the following description in conjunction with the accompanying drawings in which.

DETAILED DESCRIPTION

Figure 1:
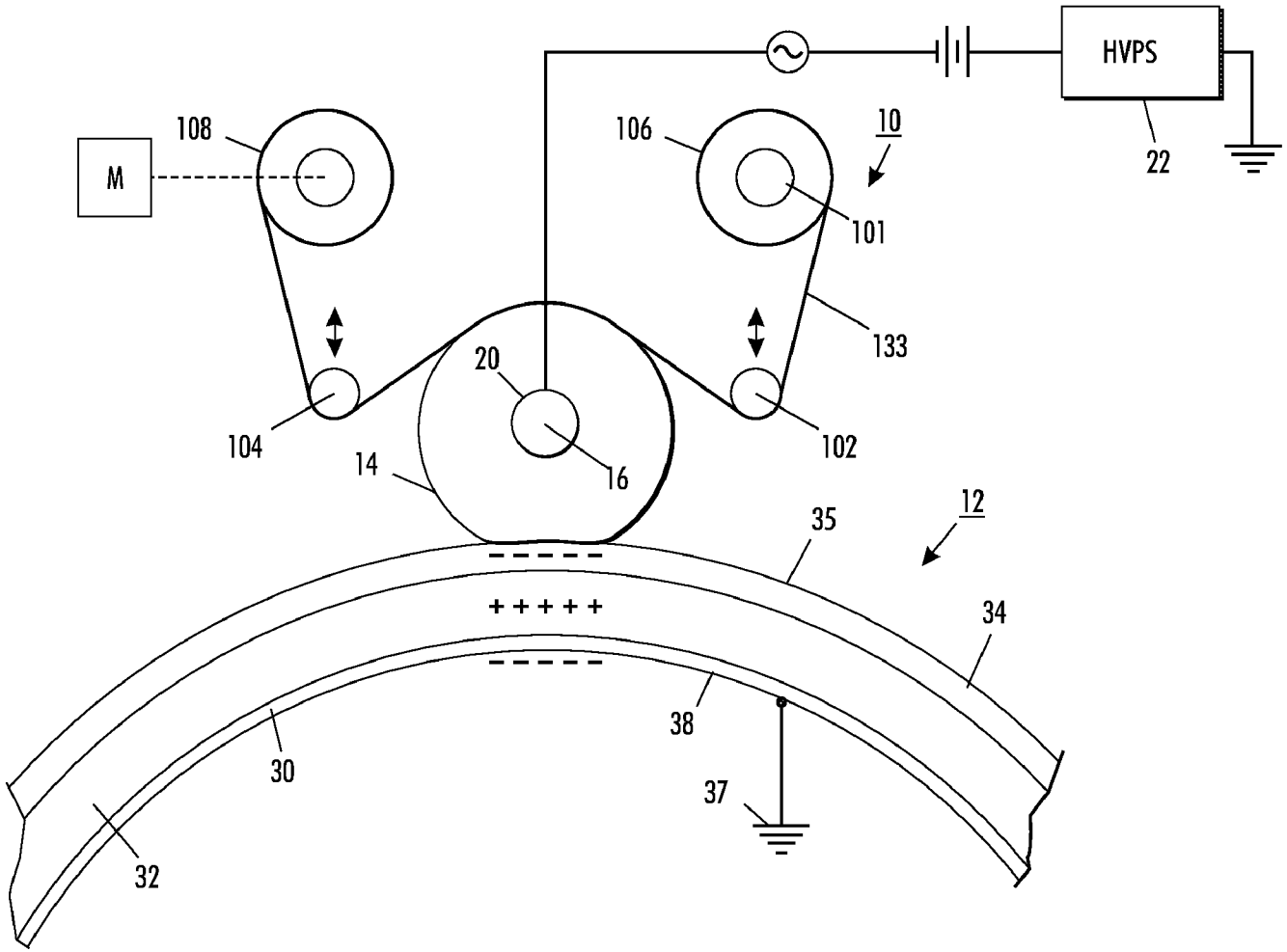
FIGS. 1 and 2 are views of a biased roll charging system in accordance with one embodiment of the present invention.

For a general understanding of the present invention, reference is made to the drawings. In the drawings, like reference numerals have been used throughout to designate identical elements.

It will be recognized, that while the present invention describes a charging system for a typical BCR used in an electrostatographic printer, embodiments of the present invention are equally well suited for use in a wide variety of other electrostatographic-type processing machines, in BTR applications, and in other applications in which uniform charges are to be placed upon moving surfaces. The disclosed invention is not limited in its application to the particular embodiment or embodiments shown herein. In particular, it should be noted that the charging apparatus of the present invention, described with reference to an exemplary charging system, may also be used in a transfer, detack, or cleaning subsystem of a typical electrostatographic apparatus since such subsystems may also require the use of a charging device. In addition, it will be recognized that the disclosed biased roll charging system may have equal application for applying an electrical charge to a member other than a photoreceptor and/or in environments outside the realm of electrostatographic printing.

Referring initially to FIG. 1, one embodiment of a biased roll charging system is shown in the context of an exemplary electrostatographic reproducing apparatus, employing a drum 12 including a photoconductive surface 35 deposited on an electrically grounded conductive substrate 38. A motor (not shown) engages with drum 12 for rotating the drum 12 to advance successive portions of photoconductive surface 35 through various processing stations disposed about the path of movement thereof, as is well known in the art. Initially, a portion of drum 12 passes through a charging station where a charging device in accordance with the present invention, indicated generally by reference numeral 10, charges the photoconductive surface on drum 12 to a relatively high, substantially uniform potential.

Referring now, more particularly, to the bias roll charging system 10, a conductive roll member 14 is provided in contacting engagement with the photoreceptor member 12. The conductive roll member 14 is axially supported on a conductive core or shaft 20, situated transverse to the direction of relative movement of the photoreceptor member 12. In one embodiment, the roll member 14 is provided in the form of a deformable, elongated roller supported for rotation about an axis 16 and is preferably comprised of a polymer material such as, for example, neoprene, E.P.D.M. rubber, Hypalon® rubber, nitrile rubber, polyurethane rubber (polyester type), polyurethane rubber (polyether type), silicone rubber, Viton®/Fluorel® rubber, epichlorohydrin rubber, or other similar materials having a DC volume resistivity in the range of $10^3$ to $10^7$ ohm-cm after suitable compounding with carbon particles, graphite or other conductive additives. These materials are chosen for the characteristic of providing a deformable structure while in close proximity or contact with the photoreceptor member, as well as wearability, manufacturability and economy. The deformability of the roller member 14 is important to provide a nip having a substantially measurable width while being engaged with the photoreceptor 12.

A high voltage power supply 22 is connected to roll member 14 via shaft 20 for supplying an oscillating input drive voltage to the roll member 14. Voltage levels or voltage signal frequencies may be desirable in accordance with other limiting factors dependent on individual machine design such as, the desired charge level to be induced on the photoreceptor or the speed of imaging operations desired. The oscillating input voltage and circuit connecting the power supply 22 to shaft 20 is discussed in greater detail below.

With particular regard to biased roll charging, a suitable photoreceptive member 12 has the property of injecting a single sign of mobile carriers from a charge generating layer into a charge transport layer such that, a surface charge potential having only a single charge polarity is generated on the surface of the photoreceptor member. With reference to FIG. 1, the photoreceptive member 12 generally includes a conductive substrate 38, such as, an aluminum sheet connected to a ground potential 37, a charge generating layer 30, a charge transport layer 32 comprising a photoconductive insulator such as, selenium or any of a variety of organic compositions, and a overcoating 34, forming the outer surface 35 of the photoreceptor member.

The charging operation involves the application of an AC voltage signal superimposed over a DC voltage from the bias charging system 10 to the photoconductive surface of photoreceptor 12, which creates a voltage potential across the photoreceptor to ground 37. In DAD systems, the outer layers 34 and 35 of the photoreceptor are only capable of transporting positive charges generated in the charge generating layer when it is exposed to light. When in the dark, the voltage breakdown generated in the pre and post nip region of the BCR nip creates a uniform charge on the charge transport layer or overcoat. Any contamination or surface defects that inhibit the voltage breakdown in the nip regions, creates non-uniform final voltage of the photoreceptor going into the expose step of the electrophotographic process. This non-uniformity creates varying spot sizes of the halftones which in turn create streaks in final output.

The web cleaning system 100 consists of a supply roll 106 having a shaft 07 therethrough, two tension rolls 104 and 102, and a take up roll 108, all of which are parallel to each other when they are rotatably mounted in the two support structures that are located at each end of the rolls.

When the web cleaning system 100 is installed, the supply roll, tension roll; and take up roll are all parallel to the photoconductor drum. A length of web 133, having the appropriate texture and BCR cleaning characteristics, is wrapped around and stored on the supply roll with a free end located around a portion of the two tension rolls and attached to the take up roll. The tension roll presses the web against the photoconductive drum roll. Tension rolls 104 and 102 provide a wrap angle between 70 degrees to 180 degrees about the BCR surface. It should be noted that optional tension rolls 104 and 102 can be selectively engaging and disengaging the web material into contact with the surface of the bias roll member by machine controller or by a mechanism used by the end user of the electrophotographic device.

The take-up roll 108 is coupled to a motor to rotate the take-up roll, thereby, pulling fresh web material from the supply roll. The supply roll 106 with the web 100 and tension rolls 104 and 102 are not rotatably driven, though some slight drag via a clutch mechanism which impose on the rotatability of the supply roll, such as by a leaf spring (not shown), free wheeling and inadvertent unraveling of the web therefrom. The clutch mechanism 101, tension rolls 104 and 102 and motor co-acts with each other so that said elongated web material generates a normal force on said bias roll member between 10 g/cm to 40 g/cm. This configuration causes the web material to be transversed around the roll in the same direction as the charge roll rotation direction.

During operation of the charging system, the take-up roll motor is rotated a few degress at selectable time intervals in order to provide clean and fresh web material to come into contact with the surface of the BCR. This contact causes any loose toner additive or toner particles to adhere to the web and be removed from the surface of the charge device, thereby providing a charging system that creates a uniform charge on the receptor. Since the web material is continually renewed from the supply roll, the cleaning device does not fill up with contamination in any area along the charge roll surface. This ensures no streaks are formed due to non-uniform charge in the perpendicular direction to the photoreceptor rotation direction.

In another embodiment, the supply roll and the take-up roll are positioned opposite as described above. In this manner, the web material is traversed in a direction opposite to the direction of the charge roll rotation. The web material may be woven or non-woven, so long as it has a surface texture suitable to collect toner from the charging roll and has a sufficient thickness and strength to prevent the web from being torn when the web is pulled through to the take up roll.

Figure 2:
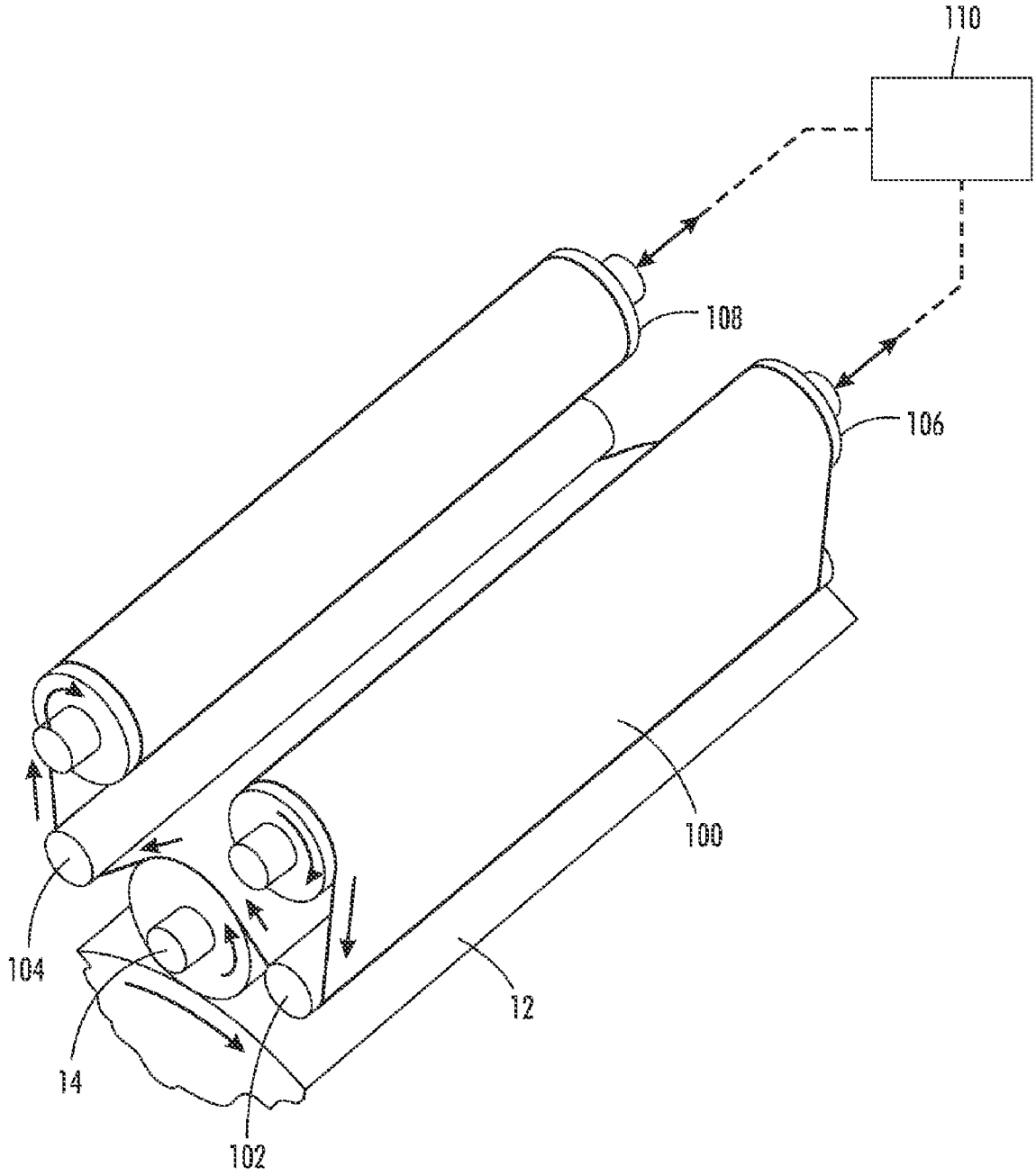

In an addition embodiment, the supply and take-up rolls may be oscillated in a direction perpendicular to the rotation of the charge roll. Using a traversing mechism 110 shown in FIG. 2, either the supply roll, the take-up roll, or both are traversed in the cross process direction to ensure that no single area of the charge roll surface is under the same location on the web material at any given time.

Figure 3:
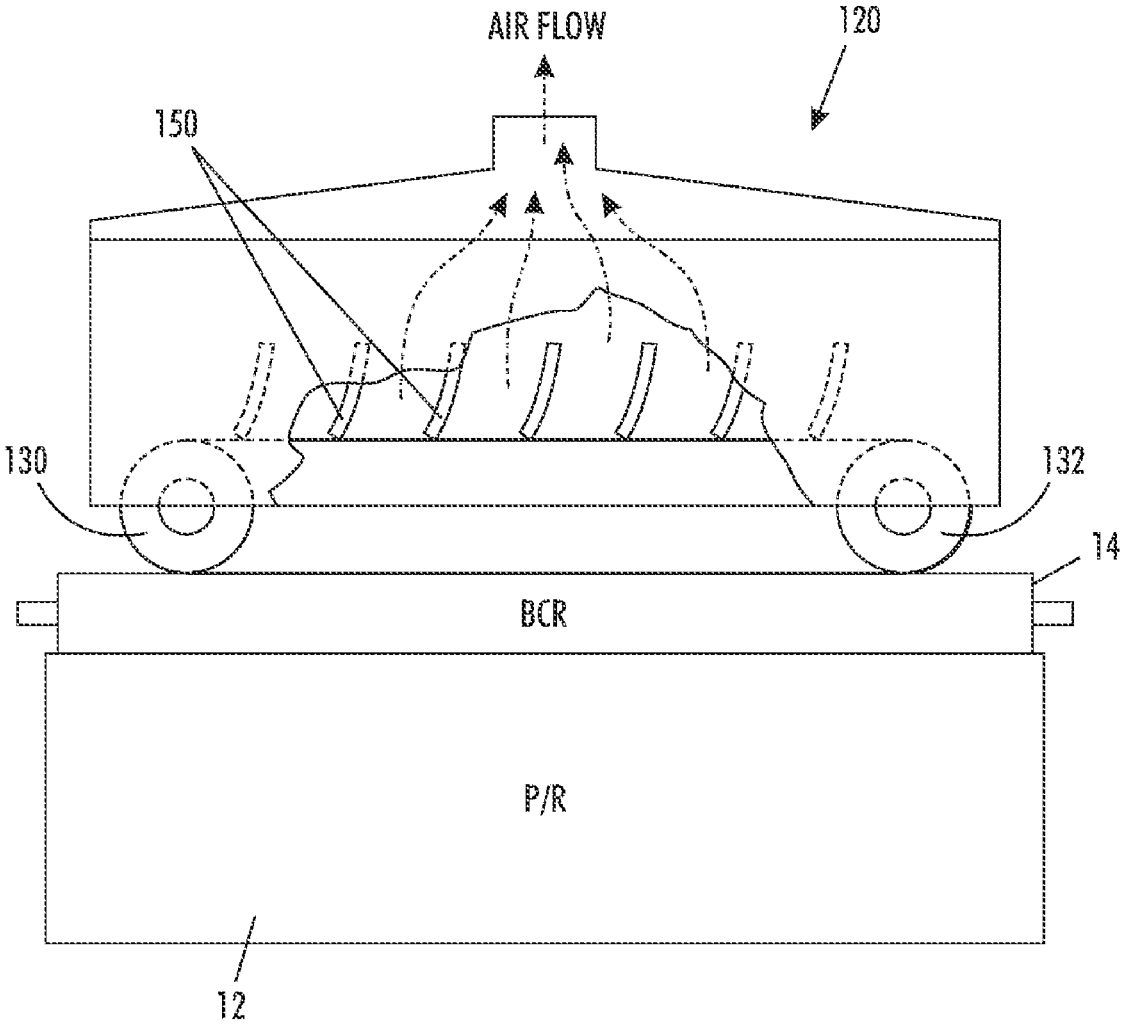
FIGS. 3 and 4 are views of a biased roll charging system in accordance with another embodiment of the present invention.
Figure 4:
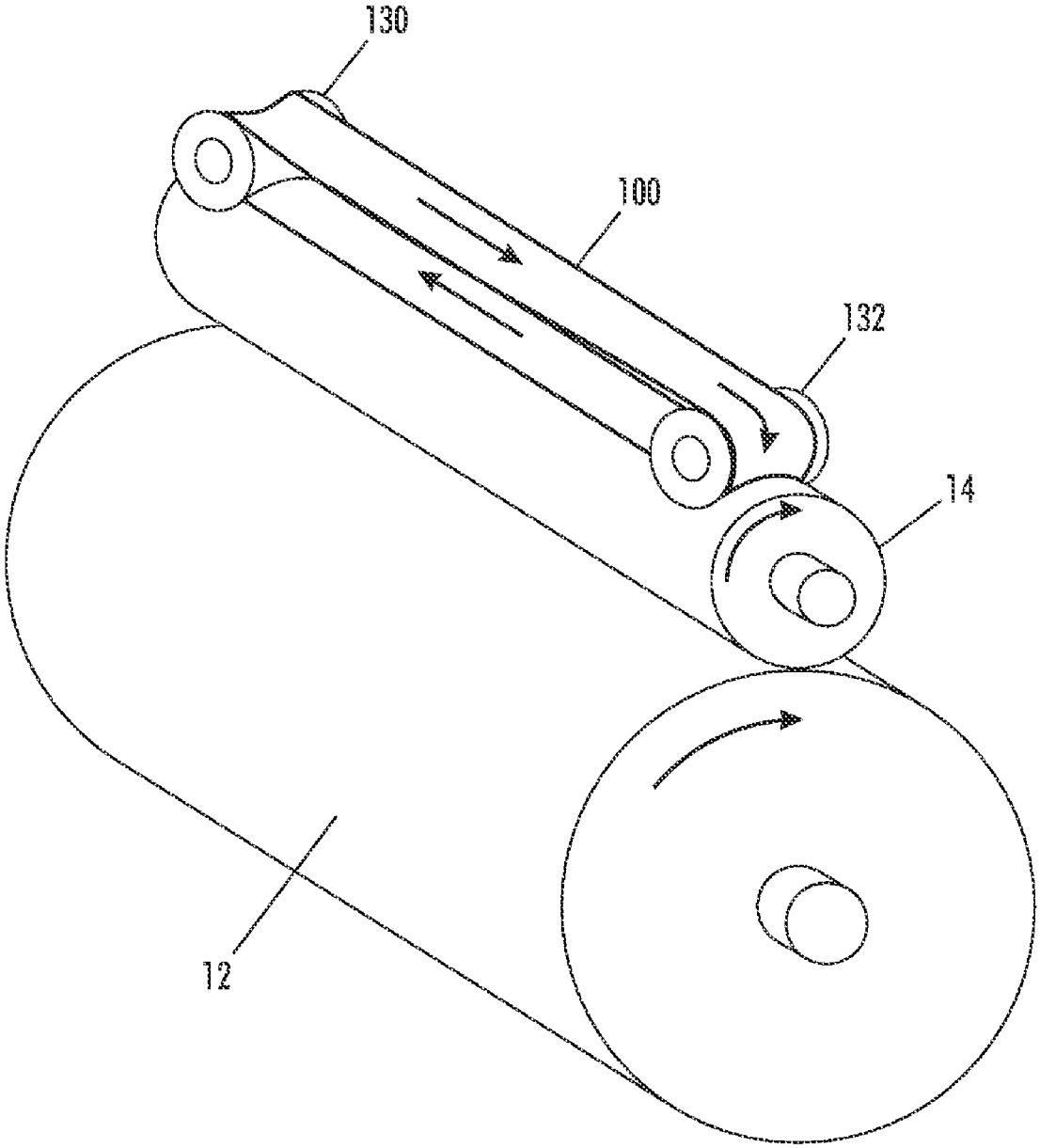

Refer to FIGS. 3 and 4 another embodiment of the present disclosure, a cleaning mechanism for cleaning the bias roll member wherein the bias roll member is rotated in the process direction and the web material is translated along the roll surface in a direction being substantially transverse to the process direction. The web material is entrained between a first support roller 130 and a second support roller 132 which urges the elongated web material into contact with bias roll member 14. The first support roller 130 and the second support roller 132 are contoured to a radius substantially equal to the radius of the bias roll member 14. The first support roller and the second support roller being sized so that the width of web of cleaning cloth material covers between 5 degrees to 180 degrees of the curvature of the bias roll member. The first support roller and the second support roller are positioned so that the web material generates a normal force on the bias roll member between 10 g/cm to 40 g/cm. Additionally, there may be a stationary backing feature between the first and second support roller to provide improved contact between the web material and the entire length of the roll surface. The first support roller and the second support roller can be selectively engaging and disengaging the elongated web of cleaning cloth material into contact with the surface of said bias roll member.

Referring to FIG. 3, another embodiment of the present disclosed cleaning mechanism for cleaning the bias roll member can include a supplimentary cleaning device for cleaning the web material as illustrated in the FIG. 4. This embodiment includes disturber members 150 which act to dislodge collected materials from the web material, an enclosure 120 and a vacuum system to clear the collected materials from the enclosure 120. Disturber members 150 may be urethane, EPDM rubber, or plastic material. In normal operation, the web material is moved around the two support rolls 130 and 132 so that the web moves perpendicular to the rotation of the charge roll. The contact of the web with the surface of the charge roll causes contamination to be removed from the surface of the charging roll. As the web passes under the disturber members, the contamination is scraped from the web and made airborne. The airflow provided in the enclosure 120 carries the airborne contamination to a filter or other receptacle. The web material is now cleaned and brought into contact with the charging roll surface to repeat the process.

It is, therefore, apparent that there has been provided, in accordance with the present invention, a charge roll cleaning device that fully satisfies the aims and advantages set forth hereinabove and does not exhibit the inherent contamination capacity issues in current cleaning devices. While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An apparatus for applying an electrical charge to a member to be charged, comprising:

a bias roll member situated in contact with a surface of the member to be charged;

means for applying an electrical bias to said bias roll member; and a cleaning mechanism for cleaning said bias roll member, said cleaning mechanism comprises an elongated web of cleaning cloth material being translated in respect to said bias roll member, cleaning mechanism further comprises a supply roll of said elongated web of cleaning cloth material, and a take-up roll for said elongated web of cleaning cloth material; a motor operatively coupled to said take-up roll to drive said take-up roll for selectively advancing of said elongated web of cleaning cloth material from said supply roll to said take-up roll to provide a clean portion of said elongated web of cleaning cloth material to clean said bias roll member, said supply roll includes a clutch mechanism coupled thereto said clutch mechanism providing a predefined drag force and wherein said clutch mechanism, said first and second idler members and said motor co-acts with each other so that said elongated web of cleaning cloth material generates a normal force on said bias roll member between 10 g/cm to 40 g/cm.

2. An apparatus for applying an electrical charge to a member to be charged, comprising:

a bias roll member situated in contact with a surface of the member to be charged;

means for applying an electrical bias to said bias roll member; and a cleaning mechanism for cleaning said bias roll member, said cleaning mechanism comprises an elongated web of cleaning cloth material being translated in respect to said bias roll member, cleaning mechanism further comprises a supply roll of said elongated web of cleaning cloth material, and a take-up roll for said elongated web of cleaning cloth material; a motor operatively coupled to said take-up roll to drive said take-up roll for selectively advancing of said elongated web of cleaning cloth material from said supply roll to said take-up roll to provide a clean portion of said elongated web of cleaning cloth material to clean said bias roll member, and wherein said cleaning mechanism includes means for translating said elongated web of cleaning cloth material perpendicular to said process direction.

3. The apparatus of claim 2, wherein said cleaning mechanism further comprises a first idler member and a second idler member for wrapping said elongated web of cleaning cloth material about said bias roll member.

4. The apparatus of claim 3, wherein said first idler member and said second idler member provide a wrap angle between the web and the bias roll member between 5 degrees to 180 degrees.

5. The apparatus of claim 2, wherein said supply roll includes a clutch mechanism coupled thereto said clutch mechanism providing a predefined drag force.

6. The apparatus of claim 2, wherein said take up roll and said supply roll includes said translating means.

7. The apparatus of claim 2, wherein said cleaning mechanism further comprises means for selectively engaging and disengaging said elongated web of cleaning cloth material into contact with the surface of said bias roll member.

8. The apparatus of claim 2, wherein said cleaning mechanism further comprises a controller for selectively translating said elongated web of cleaning cloth material.

9. A xerographic printing machine having an apparatus for applying an electrical charge to a member to be charged, comprising:

a bias roll member situated in contact with a surface of the member to be charged;

means for applying an electrical bias to said bias roll member; and a cleaning mechanism for cleaning said bias roll member, said cleaning mechanism comprises an elongated web of cleaning cloth material being translated in respect to said bias roll member, cleaning mechanism further comprises a supply roll of said elongated web of cleaning cloth material, and a take-up roll for said elongated web of cleaning cloth material; a motor operatively coupled to said take-up roll to drive said take-up roll for selectively advancing of said elongated web of cleaning cloth material from said supply roll to said take-up roll to provide a clean portion of said elongated web of cleaning cloth material to clean said bias roll member, said cleaning mechanism includes means for translating said elongated web of cleaning cloth material perpendicular to said process direction.

10. A xerographic printing machine having an apparatus of claim 9, wherein said cleaning mechanism further comprises a first idler member and a second idler member for wrapping said elongated web of cleaning cloth material about said bias roll member.

11. A xerographic printing machine having an apparatus of claim 10, wherein said first idler member and said second idler member provide a wrap angle between the web and the bias roll member between 5 degrees to 180 degrees.

12. A xerographic printing machine having an apparatus of claim 9, wherein said take up roll and said supply roll includes said translating means.

13. A xerographic printing machine having an apparatus of claim 9, wherein said cleaning mechanism further comprises means for selectively engaging and disengaging said elongated web of cleaning cloth material into contact with the surface of said bias roll member.

14. A xerographic printing machine having an apparatus of claim 9, wherein said cleaning mechanism further comprises a controller for selectively translating said elongated web of cleaning cloth material.

15. An apparatus for applying an electrical charge to a member to be charged, comprising:

a bias roll member situated in contact with a surface of the member to be charged;

means for applying an electrical bias to said bias roll member; and a cleaning mechanism for cleaning said bias roll member, said cleaning mechanism comprises an elongated web of cleaning cloth material being translated in respect to said bias roll member, and wherein said cleaning mechanism includes means for translating said elongated web of cleaning cloth material perpendicular to said process direction.

* * * * *